US006575209B2

(12) United States Patent
Gora

(10) Patent No.: US 6,575,209 B2
(45) Date of Patent: Jun. 10, 2003

(54) PROPORTIONING HEAD

(75) Inventor: Heinz-Jürgen Gora, Hamburg (DE)

(73) Assignee: Eppendorf AG, Hamburg (DE)

( * ) Notice: Subject to any disclaimer, the term of this patent is extended or adjusted under 35 U.S.C. 154(b) by 0 days.

(21) Appl. No.: 10/016,162

(22) Filed: Nov. 30, 2001

(65) Prior Publication Data

US 2002/0066494 A1 Jun. 6, 2002

(30) Foreign Application Priority Data

Dec. 1, 2000 (DE) ..... 100 59 702

(51) Int. Cl.[7] ..... B65B 1/04

(52) U.S. Cl. ..... 141/238; 141/130; 422/99; 422/100; 73/864.14-864.17

(58) Field of Search ..... 141/130, 104, 141/234, 237, 242, 247; 73/864.01, 864.25; 22/99, 100

(56) References Cited

U.S. PATENT DOCUMENTS

| | | | | |
|---|---|---|---|---|
| 4,258,761 A | | 3/1981 | Bennett, Jr. | |
| 4,478,094 A | | 10/1984 | Salomaa et al. | |
| 4,779,467 A | | 10/1988 | Rainin et al. | |
| 4,830,832 A | | 5/1989 | Arpagaus et al. | |
| 5,226,462 A | | 7/1993 | Carl | |
| 5,497,670 A | | 3/1996 | Carl | |
| 5,915,284 A | | 6/1999 | Metzer et al. | |
| 5,961,925 A | | 10/1999 | Reudiger et al. | |
| 6,006,800 A | * | 12/1999 | Nakano | 141/130 |
| 6,116,099 A | | 9/2000 | Carl | |
| 6,182,719 B1 | * | 2/2001 | Yahiro | 141/130 |
| 6,240,984 B1 | * | 6/2001 | Fawcett et al. | 141/130 |
| 6,325,114 B1 | * | 12/2001 | Bevirt et al. | 141/130 |

FOREIGN PATENT DOCUMENTS

DE 9712195 9/1998

OTHER PUBLICATIONS

Patent Abstract of Japan, JP–11271325A, Oct. 8, 1999.

* cited by examiner

*Primary Examiner*—Steven O. Douglas
(74) *Attorney, Agent, or Firm*—Sidley Austin Brown & Wood, LLP

(57) ABSTRACT

A proportioning head comprising a head plate, a multiplicity of pipette tips in plastic in a matrix array the tip apertures of which are disposed below the head plate and which are mounted at top of the head plate wherein the upper apertures of the pipette tips are accessible from the upper surface of the head plate, and a centering plate which has a multiplicity of centering holes in the same matrix array as have the pipette tips the inner diameter of which is tailored to the outer diameters of centering portions of the pipette tips disposed below the head plate in such a way that the centering plate is adapted to the pushed onto the centering portions while aligning the centering portions of the pipette tips onto the matrix array of the centering holes.

34 Claims, 4 Drawing Sheets

PROPORTIONING HEAD

BACKGROUND OF THE INVENTION

1. Field of the Invention

This invention relates to a proportioning head and specifically concerns the field of automatic proportioners. Automatic proportioners are known which have a proportioning head with a multitude of tiny steel cannulae in a matrix array which permits to simultaneously proportion a multitude of various liquid samples into the receptacles of microtitration plates. Proportioning heads are known which have 384 steel cannulae which are adopted to be introduced into the receptacles of 384-receptacles microtitration plates from above. The steel cannulae are connected to one or more displacement devices at top in order to draw in or expel a liquid through a lower cannulea aperture by displacing an air column. The proportioning head is disposed on a reception unit and this one is disposed on a shifting device which make possible shifting in the X, Y, and Z directions to introduce the steel cannulae into the receptacles of a microtitration plate for the reception or delivery of samples, to pull them out therefrom, and to shift them sideward for the transfer of samples into another microtitration plate.

2. Description of the Prior Act

The proportioning heads which are known are problematic because they involve hazards of substance entrainment and contamination. They require thorough cleaning for re-use. However, it is opportune to reuse them because the proportioning heads involve very large expenditure and are costly because of the steel cannulae.

EP 0 206 945 relates to an apparatus for adapting multiway pipetting stations to different geometries (dimensions or arrangements) of receptacles. To this end, an overall number of pipette tips are disposed in a matrix and the deformable pipette tips can be moved by means of a perforated plate in a cross direction in such a way that if they are deflected they can be aligned with a geometry of receptacles which differs from the one in case of non-deflection.

WO 95/21696 shows pipette tips in a tip holder, which can be stripped from a tip carrier.

EP 0 743 749 A1 shows arrays of pipette tips in carrier plates which can be inserted into each other to allow space-saving accommodation.

Therefore, it is the object of the invention to provide a proportioning head which has a reduced risk of entrainment and contamination while involving less expenditure.

SUMMARY OF THE INVENTION

The object of the invention is achieved by providing a proportioning head having a head plate, a multiplicity of pipette tips in plastic in a matrix array the tip apertures of which are disposed below the head plate and which are mounted at top of the head plate wherein the upper apertures of the pipette tips are accessible from the upper surface of the head plate, and a centering plate which has a multiplicity of centering holes in the same matrix array as have the pipette tips the inner diameter of which is tailored to the outer diameters of entering portions of the pipette tips disposed below the head plate in such a way that the centering plate is adapted to be pushed onto the centering portions while aligning the centering portions of the pipette tips.

The fact that the proportioning head is fitted with pipette tips in plastic considerably reduces its expenditure as compared to the known proportioning heads so that it can be used as a disposable which is thrown away after use. The manufacturer can deliver the proportioning head in a cleanliness which is such as to make it usable without any pre-treatment. It may be thrown away without any after-treatment after use. A proportioning head having pipette tips in plastic which have dimensions as are required for insertion into the receptacles of microtitration plates can only be produced at a dimensional stability which is critical for an insertion of the pipette tips into the receptacles of a higher-density microtitration plate which has a larger number of receptacles. Therefor, the proportioning head comprises a centering plate which, when in an operational position, uses its centering holes to align the pipette tips, on their centering portions, onto the matrix array of the centering holes that corresponds to the matrix array of pipette tips in the head plate. As a result, the pipette tips with their tip apertures are readily adapted to be inserted into the receptacles of a higher-density microtitration plate that have the same matrix array as have the centering holes and pipette tips in the head plate.

The centering plate, if used for lower-density microtitration plates, particularly microtitration plates having 384 receptacles, generally need not be in its operational position in which centering holes align the pipette tips at their centering portions. For this application case, it is possible to remove the centering plate or to displace it towards the head plate to such an extent that the pipette tips are lowerable approximately up to the bottom of the receptacles of microtitration plates, which makes it possible to completely receive the liquid contained in the receptacles. In contrast, for use in higher-density microtitration plates, particularly microtitration plates having 1536 receptacles, the centering plate is preferably placed in its operational position so that correct alignment of the tip apertures onto the receptacle apertures which are far smaller is achieved. At this point, it is unharmful for a mere delivery of liquid if the centering plate, when in its operational position is at a smaller spacing above the tip apertures because it is sufficient for delivery to bring the tip apertures closer to the apertures of the microtitration plate receptacles or, what is better, to slightly immerse them in these. For instance, the proportioning head may be fitted with 384 pipette tips, which makes it possible to receive or deliver liquid form or into all of the receptacles in a single step for 384-receptacle microtitration plates and at least to deliver liquid into all of the receptacles in four steps for 1536-receptacle microtitration plates.

The proportioning head may be employed on automatic proportioners in lieu of a conventional proportioning head having steel cannulae. Basically, it is possible to design the head plate and/or centering plate as separable components which can even be left permanently on automatic proportioners as they are under a low risk of contamination and can be cleaned more easily than can pipette tips. Basically, it is possible to manufacture the head plate and/or centering plate form metal, glass or another material. In such an aspect, the pipette tips may be adapted to be exchangeably connected to the head plate and to be brought together with the centering plate only in an application case. However, it is preferred that the head plate and/or the centering plate be of a plastic as well. This makes it possible to design the head plate and/or centering plate as a part of a disposable, which can reduce the expenditure for an exchange and can even further diminish the risk of entrainment and contamination.

An automatic proportioner can be provided with a reception unit which is adapted to receiving such a disposable.

The pipette tips can be connected to the at least one displacement device of the automatic proportioner via pin-shaped or conical members which are sealingly seated at the inner edge of upper apertures of the pipette tips or of mounting holes of the head plate in which the pipette tips are sealingly seated at the circumference.

The inner diameters of the centering holes have preferably been chosen to be slightly larger than the outer diameters of the centering portions where the differences in diameter are determined by the accuracy which is required for aligning the tip apertures on the receptacles of the microtitration plate. Preferably, the centering portions are substantially cylindrical shank portions or slightly conical shank portions of the pipette tips. In the latter case, the inner diameters of the centering apertures require to be tailored to the maximum outer diameters of the centering portions.

According to an advantageous aspect, the pipette tips have conical tip portions, which possess the tip apertures, below the centering portions. This can facilitate the insertion of the pipette tips into the receptacles of the microtitration plate or can favourably influence the delivery of liquid.

The positioning of the centering plate with respect to the head plate can also be accomplished by a displacement device of an automatic proportioner. An advantageous aspect of the proportioning head plate and the centering plate relative to each other and/or with each other. The positioning and/or connecting devices may form part of a disposable part. They may interact with displacement devices of an automatic proportioner which can have an appropriately equipped reception unit for the proportioning head.

The positioning and/or connecting devices may specifically have tie plates which are fixed to the centering plate or head plate and are guided on the head plate or centering plate and/or are adapted to be releasably joined to the head plate or centering plate. The tie plates, in particular, may serve for engagement by a displacement device of an automatic proportioner or may cause an alignment of the centering plate with respect to the head plate, which supports the precise alignment of the tip apertures on the receptacles of a microtitration plate.

To releasably connect the head plate to the centering plate, the tie plates and the head plate or the centering plate can have snap-in elements to get the tie plates caught with the head plate or centering plate. For example, the snap-in elements may have snap-in notches and snap-in projections wherein the edges of the head plate or centering plate can be prepared as snap-in projections which interact with snap-in notches in the tie plates.

Preferably, the connecting devices are configured so as to allow to reasonably connect the head plate and the centering plate to each other at different spacings. Thus, the connecting devices can allow to releasably connect the head plate to the centering plate at a spacing at which the pipette tips are maximally pushed into the centering holes. Such connection can particularly be utilized for proportioning microtitration plates during which pipette tips are immersed approximately until they reach the bottom of the receptacles. In order to make do with pipette tips which are as short as possible the centering plate will preferably bear on the head plate here.

According to another aspect, the connecting devices allow to releasably connect the head plate to the centering plate at a spacing at which the centering holes accommodate a lower area of the centering portions. This is the functional position in which h the centering plate centers the pipette tips so that these are adapted to be precisely aligned on the apertures of a higher-density microtitration plate.

According to further aspect, the connecting devices allow to releasably connect the head plate to the centering plate in an intermediate position between the two aforementioned positions. This intermediate position may be used, for instance, to align the pipette tips and to be deeply immersed into receptacles of a microtitration plate despite this. For instance, this can be utilized for proportioning operations on a microtitration plate wherein the receptacles are not formed to be particularly deep.

Finally, according to an aspect, the connecting devices allow to releasably connect the head plate to the centering plate at a spacing at which the pipette tips with their tip apertures are within or above the centering holes. This connection can be utilized to protect the pipette tips from damage, particularly when those are transported, stored, assembled or maintained.

The head plate and the centering plate are preferably aligned in parallel with each other in all of the aforementioned connections.

The object is further achieved by the proportioning head having

- a head plate wherein there are a multiplicity of mounting holes in a matrix array which have a substantially cylindrical or slightly conical hole portion and a constricted area each below, and
- a multiplicity of pipette tips in plastic in a matrix array which have a mounting area each at top which has a collar and a substantially cylindrical or slightly conical mounting portion of a reduced diameter below it with the outer diameter of the collar being tailored to the inner diameter of the substantially cylindrical or slightly conical hole portion and the outer diameter of the substantially cylindrical or slightly conical hole portion being tailored to the inner diameter of the constricted area in such a way that the collar has a press fit in the substantially cylindrical or slightly conical hole portion and the substantially cylindrical or slightly conical mounting portion has a press fit in the constricted area.

The head plate and the pipette tips may be separately manufactured at a relatively low torsion and tolerance. Pressing the pipette tips into the head plate, moreover, makes it possible to mount the pipette tips in the head plate at a particularly low tolerance. As a result, the proportioning head has a dimensional accuracy which may be sufficient for may applications (e.g. 348-receptacle microtitration plates) with no need for an extra centering plate. However, the centering plate may be additionally employed, particularly if higher-density microtitration plates are to be used (e.g. 1536-receptable microtitration plates).

In this proportioning head, the head plate may also be permanently connected to an automatic proportioner or another instrument. Regardless of whether the head plate was connected to the pipette tips already by the manufacturer, which preferably is the case, or is connected thereto by the user later it may consist of most different materials, particularly metal or glass. However, it is preferred that the head plate be made of a plastic, which particularly makes it more opportune to design the proportioning head as a disposable part.

According to another aspect, the mounting holes are designed with downwardly formed cup-like portions of the head plate, which allows to save materials and to obtain a dimensionally stable design.

According to another aspect, particularly good dimensional stability is achieved by manufacturing the mounting holes of the head plate and/or the pipette tips by means of tools the form-imparting contours of which for the mounting holes and/or the pipette tips are made in a continuous operation.

According to another aspect, at least one gas-permeable filter to retain aerosols and liquid is associated with the upper apertures of the pipette tips. This filter is intended to prevent liquid from getting into a displacement system joined to the proportioning head. Such a filter may be located in the upper region of each pipette tip and/or in each mounting hole of the head plate and/or at the upper surface of the head plate. However, the at least one filter may also be disposed in an automatic proportioner or a reception unit thereof. The configuration including at leas t one filter is possible in all of the proportioning heads heretofore described.

According to another aspect, the proportioning head has two pins perpendicular to the head plate for being guided in guide holes. The guide holes may also be formed in the proportioning head and/or a microtitration plate. A microtitration plate provided with guide holes which is tailored to the proportioning head is an appropriate aspect of the invention. The pins and guide holes are an additional mechanical aligning aid.

The pins may be fixedly connected to the centering plate or head plate and can be guide holes of the head plate or centering plate. In addition, they may have a guide in guide holes of a microtitration plate. If the pins are fixedly connected to the centering plate they may project therefrom on either side in order to be guided in guide holes of the head plate, on one hand, and in guide holes of a microtitration plate, on the other.

It is preferred that the plates in which guide holes are formed have a guide hole each in the shape of a circular hold and a guide hole in the shape of an elongated hole.

It is further preferred that the guide pins be disposed at diagonally opposed corners of the proportioning head.

Likewise, in all proportioning heads heretofore described, the head plate and/or the pipette tips and/or the centering plate can be made of a single plastic or different plastics. The head plate and/or pipette tips and/or centering plate are preferably moulded from a plastic. Preferably, the head plate and/or centering plate are of a relatively rigid plastic. This particularly include polycarbonate. It is further preferred that the pipette tips be of a relatively soft plastic. Preferred materials for the pipette tips are polypropylene and/or polyethylene and/or similar plastics which also include blends of ploypropylene and polyethylene.

The tie plates preferably are integrally formed with the centering plate or head plate. The tie plates can further be guided in through holes in the head plate or centering plate, which can enhance the safety of the connection of the head plate and centering plate.

A transport and refill package, which contains at least one of the proportioning heads heretofore described, further has two U-shaped rails in plastic which are pushed over opposed edges of the head plate and those of the centering plate, if any, so as to accommodate the proportioning head therebetween, and further have a removable sheeting that encloses the rails.

The sheeting may fix the U-shaped rails on the opposed edges of the head plate. Furthermore, the sheeting protects the at least one proportioning head from impurities. To use the at least one proportioning head, the sheeting and one of the rails may be removed. After this, the at least one proportioning head can be inserted into a magazine or a reception unit of an automatic proportioner where the second U-rail can be used as a handle that protects the at least one proportioning head from being touched by laboratory personnel.

According to a preferred aspect, the edges of the head plate and those of the centering plate, if any, are guided at projections and/or indentations at the insides of the guide rails and/or engage these. This arrests the proportioining heads in the transport and refill package and, if the ehads are inserted inot a magazine or a reception unit, the arresting devises will also prevent them from changing their position with respect to the U-rail which would interfere with the insertion procedure.

Preferably, the pipette tips of the proportioning head are aligned in parallel with the U-shaped rails to protect the pipette tips form damage.

According to another preferred aspect, the head plate and the centering plate are releasably mounted at a spacing from each other so that the proportioning head takes a particularly stable position within the two U-shaped rails and provides safe engagement by the projections ad indentations. It is particularly preferred that the tip apertures of the pipette tips be disposed within or above the centering holes. The head plate and centering plate will then form some sort of protective casing for the pipette tips.

The transport and refill package may specifically comprise five to ten proportioning heads.

The transport and refill package may specifically comprise five to ten proportioning heads.

The rails may be folded from a flat plastic material at a low cost. The rails may be deep-drawn to realize the projections and/or indentions.

The enclosing sheeting is preferably made of a plastic such as polyethylene or polypropylene. To make it easier to open the transport and refill package, the sheeting can have a tear-open perforation and/or tear-open thread.

BRIEF DESCRIPTION OF THE DRAWINGS

The invention will now be explained in more detail with reference to the accompanying drawings of embodiments. In the drawings.

DETAILED DESCRIPTION OF THE PREFERRED EMBODIMENT

Figure 1:
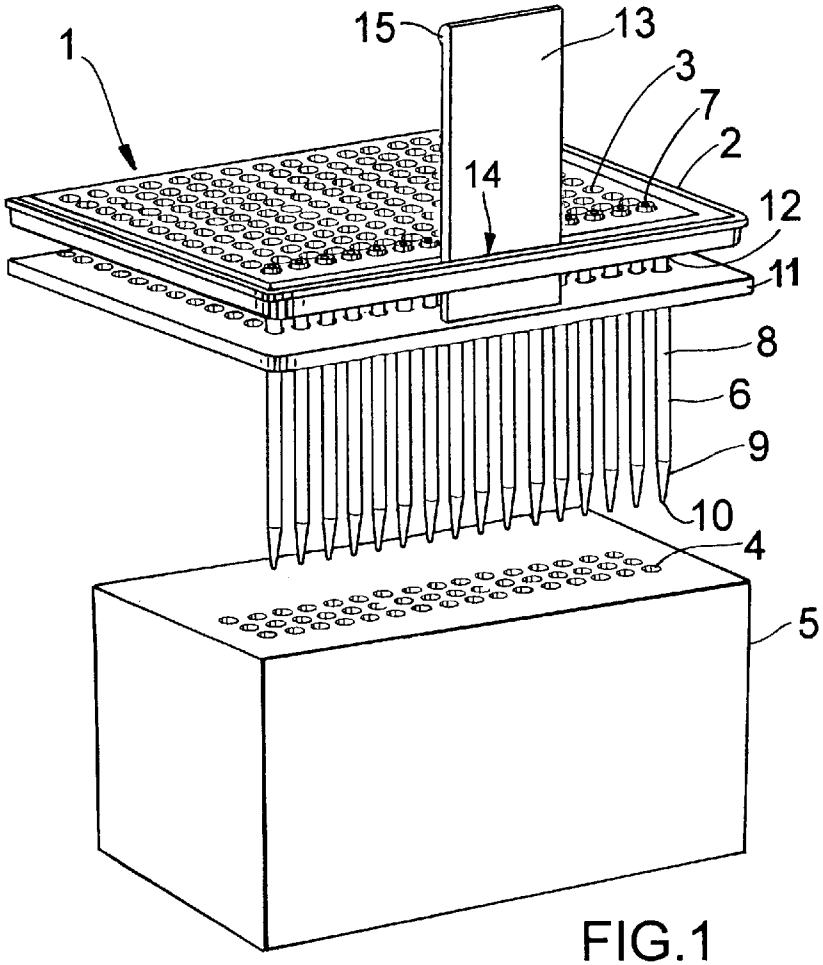
FIG. 1 shows a proportioning head, which is provided with only one row of pipette tips for reasons of simplicity, if used with a 384-receptacle microtitration plate, in a perspective side view of the forward portion.

According to FIG. 1, a proportioning head 1 has a head plate 2 with 384 mounting holes 3 which are aligned perpendicular to head plate 2 and have a matrix array corresponding to receptacles 4 of a 384-receptacle microtitration plate 5. Seated in the mounting holes 3 are pipette tips 6 which, with their upper apertures 7, are approximately flush with the upper surface of the head plate 2. Below the head plate 2, the pipette tips 6 have substantially cylindrical centering portions 8. These extend from the lower surface of the head plate 2 up to short, conical tip portions 9 at the lower ends of which the tip apertures 10 of the pipette tips 6 are formed.

Furthermore, the proportioning head 1 has a centering plate 11 which is traversed by 384 centering holes which have the same matrix array as the receptacles 4 in the 384-receptacle microtitration plate. The centering holes 12 have an inner diameter which slightly exceeds the maximum outer diameter of the centering portions 8.

Figure 2:
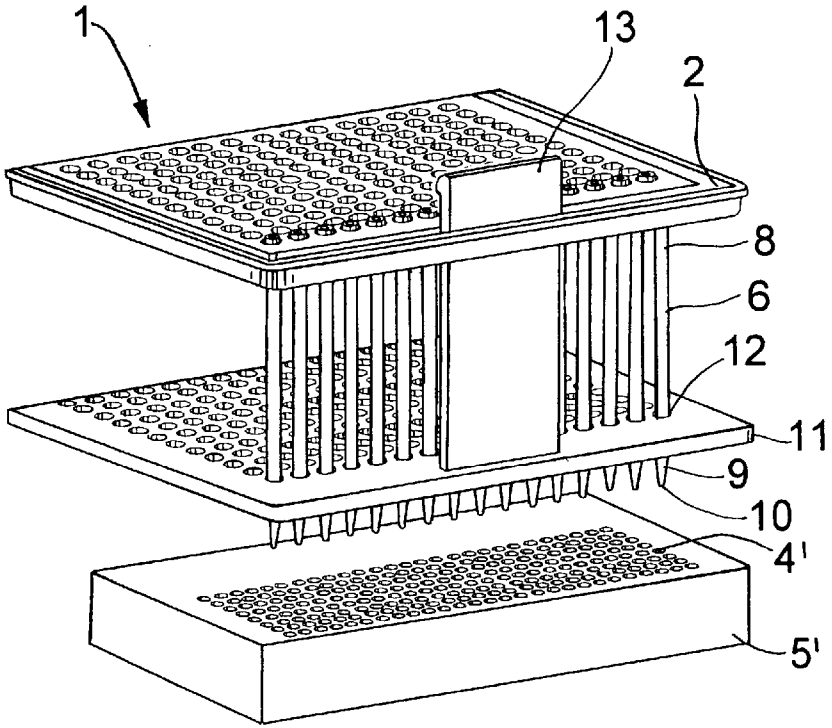
FIG. 2 shows the same proportioning head with a 1536-receptacle microtitration plate, also in a perspective side view of the forward portion.

The centering plate 11 has tie plates 13 which are integrally formed therewith, vertically stand upwards, and are guided through guide slots 14 at the edges of the head plate 2. Snap-in members (not shown) which allow the centering plate 11 to be caught with respect to the head plate 2 in positions shown in FIGS. 1 and 2 are formed between the tie plates 13 and the guide slots 14. The end of the tie plates 13 which projects beyond the head plate 2 allows to be engaged by a displacement device of an automatic proportioner which displaces the centering plate 11 into the respective position desired with respect to the head plate 2. This end has a hook 15 which can serve for coupling the displacement device or captively fixing the centering plate 11 to the head plate 2.

Both the head plate 2 and centering plate 11 are made of polycarbonate. The pipette tips 6 are of polypropylene.

Since the pipette tips 6 are fixed in mounting holes 3 of the head plate 2 they have already been aligned exactly on the receptacles 4 of a 384-recetacle microtitration plate so that the centering plate is not needed for a more precise alignment. This is why it has been displaced up to a point close to the lower surface of the head plate 2 in FIG. 1. This makes it possible to immerse the pipette tips 6 up to a point close to the bottom of the receptacles 4 of a 384-receptacle "deepwell" microtitration plate in which the depth of reception is more than 40 mm.

According to FIG. 2, the centering plate 11 has been displaced up to the lower end of the centering portions 8 by means of the tie plates 13 and has been caught in this position. The pipette tips 6 are exactly aligned by the centering portions 8 through the centering holes 12 on each fourth receptacle 4' of a 1536-receptacle microtitration plate 5' from a proportioning head 1. For this purpose, the tip portions 9 may be slightly immersed into the receptacles 4'. All receptacles 4' of the microtitration plate 5' may be filled in four proportioning steps.

Figure 3:
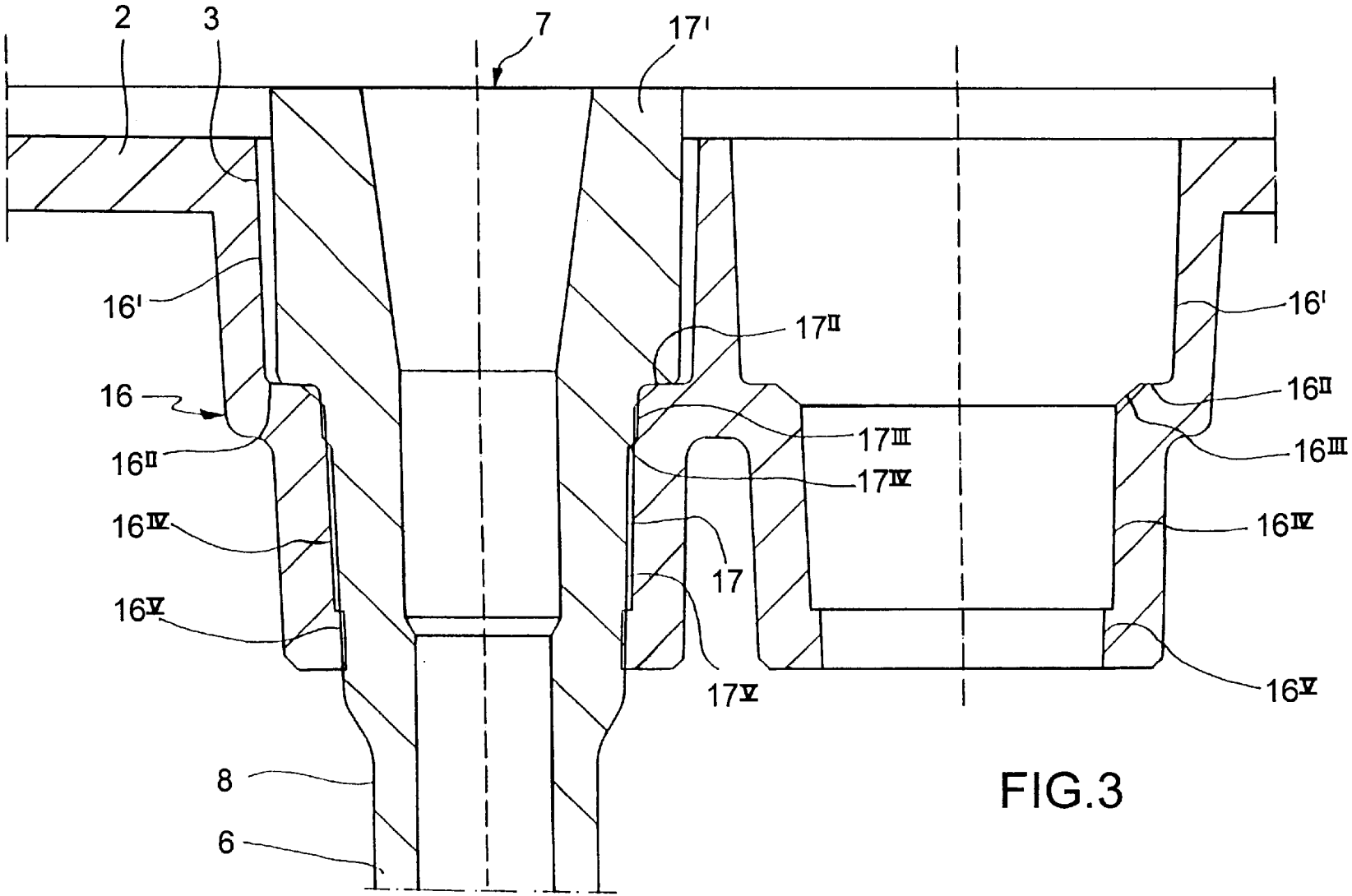
FIG. 3 shows the proportioning head in an enlarged vertical partial section through two mounting holes, wherein a mounting area of a pipette tip is only shown in one of the mounting holes for reasons of simplicity.

Details of how to mount the pipette tips 6 in the head plate 2, which causes the pipette tips 6 of 384-receptacle microtitration plates 5 already to get sufficiently aligned, are shown in FIG. 3. Accordingly, the mounting holes 3 are formed in downwardly shaped cup-like portions 16 of the head plate 2. In the portions, the mounting holes have a slightly conical reception areas 16' top, which is confined by a hole step 16" with a phase 16'" at bottom. Below the phase, a hole portion $\mathbf{16}^{IV}$ which is even less conical is located and is confined, in turn, by a constricted area $\mathbf{16}^{V}$.

The pipette tips have a mounting area 17 above the essentially cylindrical centering portion 8. It comprises a tip head 17' at top which is confined by a tip step 17" at bottom. It is followed by a short collar 17'"which is confined by another tip step $\mathbf{17}^{IV}$ at bottom. Below it, the mounting area 17 has a slightly conical mounting portion $\mathbf{17}^{V}$.

The pipette tips 6 are pressed into the mounting holes 3 from above so that their tip step 17" rests on the hole step 16". As a result, the upper edge of the pipette tips 6 is at approximately the same level as is the surface of the plate 2 and the upper apertures 7 of the pipette tips 6 are accessible from the upper surface of the plate 2.

The pipette tips 6 are retained in this position because their collar 17'" has a press fit in the slightly conical hole portion $\mathbf{16}^{IV}$ and their slightly conical mounting portion $\mathbf{17}^{V}$ has a press fit in the constricted area $\mathbf{16}^{V}$.

Figure 6:
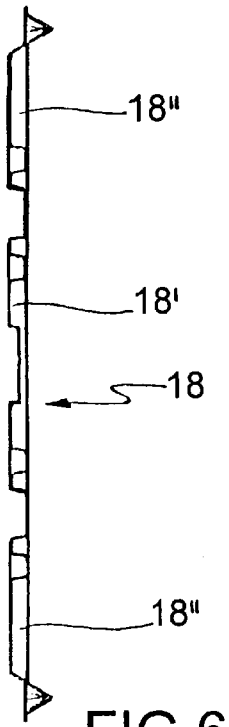
FIG. 6 shows the same rail in a section along lines VI—VI of FIG. 4.
Figure 4:
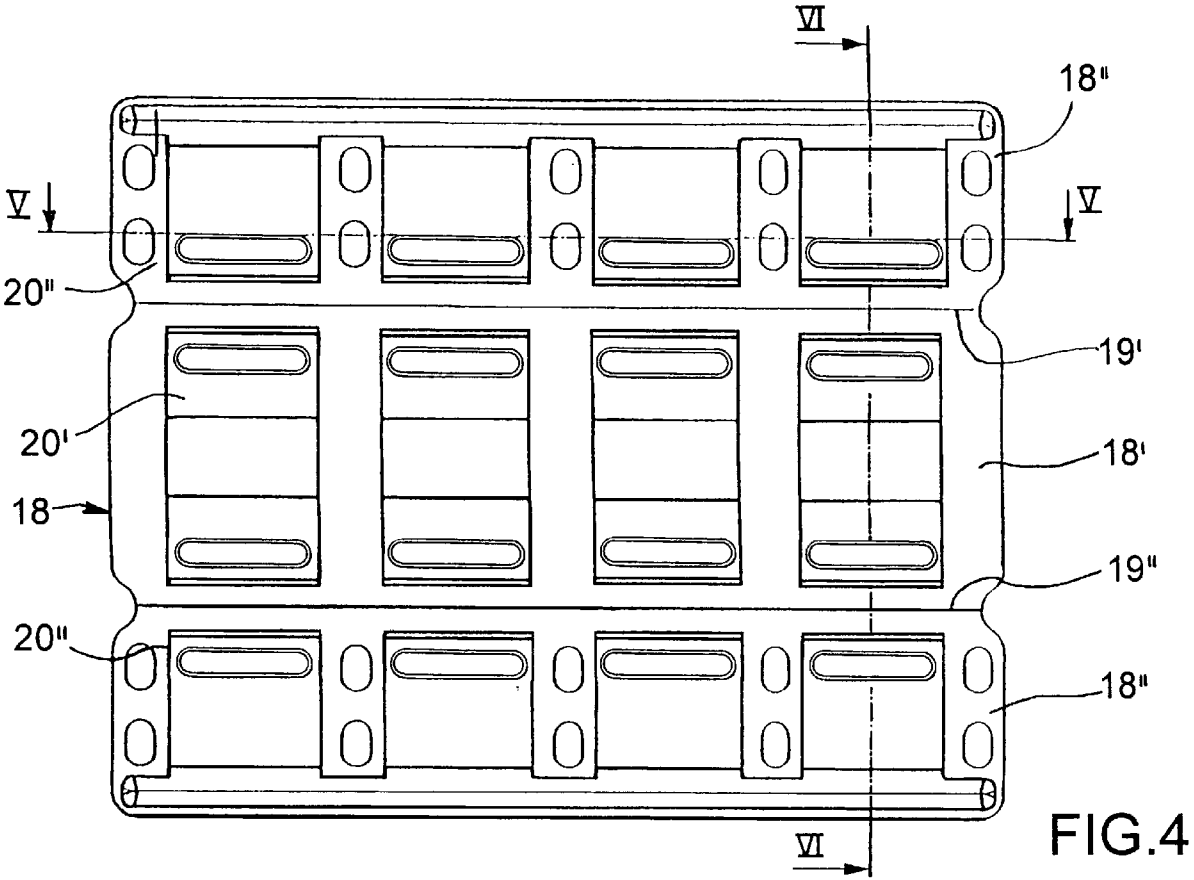
FIG. 4 shows a rail for a transport and refill package in a flatly expanded condition in a plan view.
Figure 5:
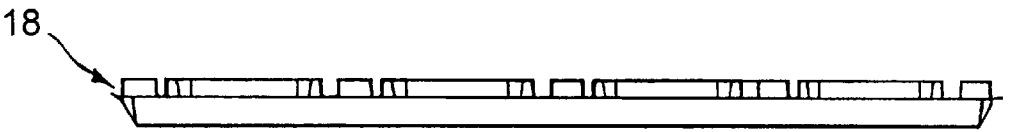
FIG. 5 shows the same rail in a section along lines V—V of FIG. 4

According to FIGS. 4 to 6, a rail 18 for a transport and refill package has three portions hinged to each other, i.e. a base portion 18' and two side portions 18". The hinge points between the portions are realized via longitudinally directed perforations 19', 19".

The base portion 18' and the side portions 18" have formed therein four groups of raised and deepened areas 20' and 20", respectively, which are oriented transversely to the longitudinal direction of the rail 18. In the longitudinal direction of the rail 18, the groups of raised and deepened areas 20' and 29", respectively, have dimensions which allow to guide a proportioning head 1 exactly in the range of spacing between the head plate 2 and the centering plate 11 if these are shifted apart to a maximum so that the hook 15 bears on the upper surface of the head plate 2 (cf. FIGS. 1 and 2).

Figure 7:
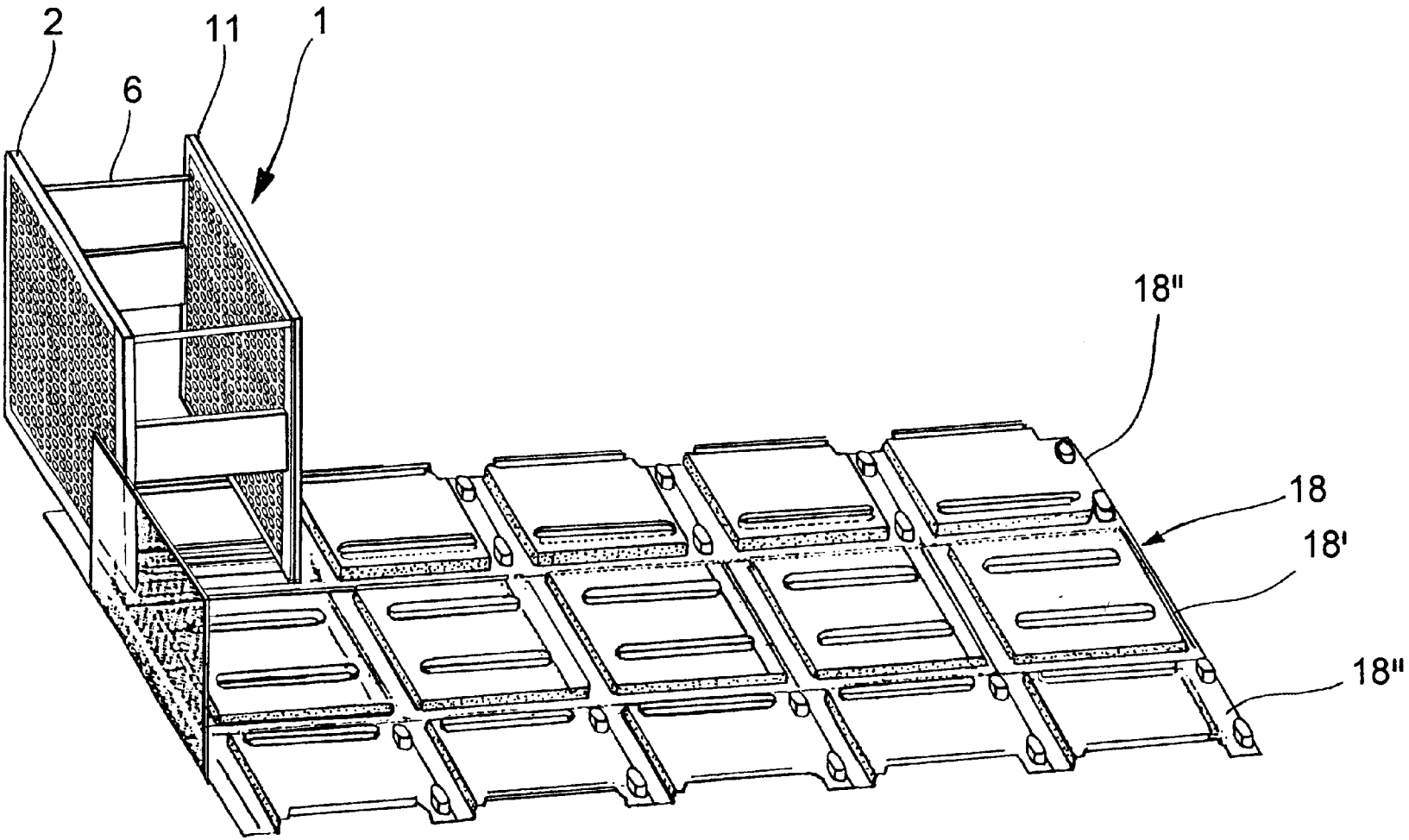
FIG. 7 shows the same rail in a flatly expanded condition with a proportioning head associated therewith.

FIG. 7 shows how a proportioning head 1 is associated with a rail 18. The proportioning head still requires to be swiveled with the narrow front-end face, on which there is the tie plate 13, into a bearing relationship against the base position 18' from the position shown. Afterwards, the side portions 18" are swiveled upwards against the longitudinal sides of the proportioning head 1. An appropriate rail is placed onto the oppositely directed front-end face of the proportioning head 1. Finally, the whole is closely enveloped by a tight-fitting sheeting. The transport and refill package will then be ready.

It is capable of transporting a total of five proportioning heads in a protected condition. To refill them, the sheeting is removed and one rail 18 is stripped. The five proportioning heads 1 are then pushed at a time into a magazine of an automatic proportioner while the side portions 18" of the other rail 18 are being grasped.

What is claimed is:

1. A proportioning head, comprising:

a head plate (2)

a multiplicity of pipette tips (6) in plastic in a matrix array the tip apertures (10) of which are disposed below the head plate (2) wherein the upper apertures (7) of the pipette tips (6) are accessible from the upper surface of the head plate (2), and a centering plate (11) which has a multiplicity of centering holes (12) in the same matrix array as have the pipette tips (6) the inner diameter of which is tailored to the outer diameters of centering portions (8) of the pipette tips (6) disposed below the head plate (2) in such a way that the centering plate (11) is adapted to be pushed onto the centering portions (6) while aligning the centering portions (8) of the pipette tips (6) onto the matrix array of the centering holes (12).

2. The proportioning head according to claim 1, wherein the head plate (2) and/or the centering plate (11) is/are made of a plastic.

3. The proportioning head according to claim 1, wherein the centering portions (8) are substantially cylindrical shank portions or slightly conical shank portions of the pipette tips (6).

4. The proportioning head according to claim 1, wherein the pipette tips (6) have conical tip portions (9), which possess the tip apertures (10), below the centering portions (8).

5. The proportioning head according to claim 1, which has positioning and/or connecting devices (13, 14) for positioning and/or releasably connecting the head plate (2) and the centering plate (11) relative to each other and/or with each other.

6. The proportioning head according to claim 5, wherein the positioning and/or connecting devices (13, 14) have tie plates which are fixed to the centering plate (11) or head plate (2) and are guided on the head plate (2) or centering plate (11) and/or are adapted to be releasably connected to the head plate (2) or centering plate (11).

7. The proportioning head according to claim 6, wherein the tie plates (13) and the head plate (2) or the centering plate (11) have snap-in elements to get the tie plates (13) caught with the head plate (2) or centering plate (11).

8. The proportioning head according to claim 7, wherein the catch elements comprise snap-in notices and snap-in projections.

9. The proportioning head according to claim 5, wherein the connecting devices (13, 14) allow to releasably connect the head plate (2) and centering plate (11) to each other at different spacings.

10. The proportioning head according to claim 5, wherein the connecting devices (13, 14) allow to releasably connect the head plate (2) and the centering plate (11) at a spacing at which the pipette tips (6) are maximally pushed into the centering holes (3).

11. The proportioning head according to claim 1, wherein the centering plate (11) bears on the head plate (2) if the pipette tips (6) are maximally pushed into the centering holes.

12. The proportioning head according to claim 5, wherein the connecting devices (13, 14) allow to releasably connect the head plate (2) to the centering plate (11) at a spacing at which the centering holes (12) accommodate a lower area of the centering portions (8).

13. The proportioning head according to claim 10, wherein the connecting devices (13, 14) allow to releasably connect the head plate (2) to the centering plate (11) in an intermediate position between the two aforementioned positions.

14. The proportioning head according to claim 5, wherein the connecting devices (13, 14) allow to releasably connect the head plate (2) to the centering plate (11) at a spacing at which the pipette tips (6) with their tip apertures (10) are within or above the centering holes (12).

15. The proportioning head according to claim 1, wherein:

the head plate (2) has a multiplicity of mounting holes (3) in a matrix array which have a substantially cylindrical or slightly conical hole portion ($16^{IV}$) and a constricted area ($16^{V}$) each below, and a multiplicity of pipette tips (6) in plastic in a matrix array which have a mounting area (17) each at top which has a collar (17''') and a substantially cylindrical or slightly conical mounting portion ($17^{V}$) of a reduced diameter below it with the outer diameter of the collar (17''') being tailored to the inner diameter of the substantially cylindrical or slightly conical hole portion ($16^{IV}$) and the outer diameter of the substantially cylindrical or slightly conical hole portion ($17^{V}$) being tailored to the inner diameter of the constricted area ($16^{V}$) in such a way that the collar (17''') has a press fit in the substantially cylindrical or slightly conical hole portion ($16^{IV}$) and the substantially cylindrical or slightly conical mounting portion ($17^{V}$) has a press fit in the constricted area ($16^{V}$).

16. The proportioning head according to claim 15, wherein the head plate (2) is made of plastic.

17. The proportioning head according to claim 16, wherein the mounting holes (3) are designed with downwardly formed cup-like portions (16) of the head plate (2).

18. The proportioning head according to claim 15, wherein the mounting holes (3) of the head plate (2) and/or the pipette tips (6) are manufactured by means of tools the form-imparting contours of which for the mounting holes (3) and/or the pipette tips (6) are made in a continuous operation.

19. The proportioning head according to claim 1, wherein at least one gas-permeable filter to retain liquid is associated with the upper apertures (7) of the pipette tips (6).

20. The proportioning head according to claim 1, which has two pins perpendicular to the head plate for being guided in guide holes.

21. The proportioning head according to claims 20, wherein the pins are fixedly connected to the centering plate or head plate and are guided in guide holes of the head plate or centering plate.

22. The proportioning head according to claim 20, wherein the guide pins are guided in guide holes of a microtitration plate.

23. The proportioning head according to claim 20, wherein one guide pin is guided in at least one circular hole and the other guide pin is guided in a least one elongated hole.

24. The proportioning head according to claim 1, wherein the head plate (2) and/or the pipette tips (6) and/or the centering plate (11) are made of a plastic.

25. The proportioning head according to claim 1, wherein the head plate (2) and/or the pipette tips (6) and/or the centering plate (11) are made of a plastic.

26. A transport and refill package, comprising at least one proportioning head (1) having a head plate (2)

a multiplicity of pipette tips (6) in plastic in a matrix array the tip apertures (10) of which are disposed below the head plate (2) wherein the upper apertures (7) of the pipette tips (6) are accessible from the upper surface of the head plate (2), and a centering plate (11) which has a multiplicity of centering holes (12) in the same matrix array as have the pipette tips (6) the inner diameter of which is tailored to the outer diameters of centering portions (8) of the pipette tips (6) disposed below the head plate (2) in such a way that the centering plate (11) is adapted to be pushed onto the centering portions (6) while aligning the centering portions (8) of the pipette tips (6) onto the matrix array of the centering holes (12); and two U-shaped rails (18) in plastic which are pushed over opposed edges of the head plate (2) and those the centering plate (11), if any, so as to accommodate the proportioning head therebetween, and which further have a removable sheeting that encloses the rails (18).

27. The transport and refill package according to claim 26 wherein the edges of the head plate (2) and those of the centering plate (11), if any, are guided at projections and/or indentations (20) at the insides of the guide rails (18) and/or which engage these.

28. The transport and refill package according to claim 26, wherein the pipette tips (6) of the proportioning head (1) are aligned in parallel with the U-shaped rails (18).

29. The transport and refill package according to claim 26, wherein the head plate (2) and the centering plate (11) are releasably mounted at a spacing from each other.

30. The transport and refill package according to claim 29, wherein the tip apertures (10) of the pipette tips (6) are disposed within and above the centering holes (12).

31. The transport and refill package according to claims 26, which comprises five to ten proportioning heads (1).

32. The transport and refill package according to claim 26, wherein the rails (18) are folded from a flat plastic material.

33. The transport and refill package according to claim 26, wherein the rails (18) are deep-drawn or are manufactured by an injection moulding technique.

34. The transport and refill package according to claim 26, wherein the wrapping sheeting has a tear-open perforation and/or tear-open thread.

* * * * *